US007190385B2

(12) United States Patent
Van Uffel

(10) Patent No.: US 7,190,385 B2
(45) Date of Patent: Mar. 13, 2007

(54) THERMAL PRINTING METHOD

(75) Inventor: Bruno Van Uffel, St. Katelijne Waver (BE)

(73) Assignee: AGFA-Gevaert N.V., Mortsel (BE)

( * ) Notice: Subject to any disclaimer, the term of this patent is extended or adjusted under 35 U.S.C. 154(b) by 229 days.

(21) Appl. No.: 11/078,092

(22) Filed: Mar. 11, 2005

(65) Prior Publication Data

US 2005/0219346 A1 Oct. 6, 2005

Related U.S. Application Data

(60) Provisional application No. 60/567,877, filed on May 4, 2004.

(30) Foreign Application Priority Data

Apr. 2, 2004 (EP) ..... 04101372

(51) Int. Cl.
*B41J 2/00* (2006.01)

(52) U.S. Cl. ..... 347/188

(58) Field of Classification Search ..... 347/188, 347/189, 191, 192, 193, 194, 183, 187
See application file for complete search history.

(56) References Cited

U.S. PATENT DOCUMENTS

| | | | | |
|---|---|---|---|---|
| 5,539,443 | A | 7/1996 | Mushika et al. | |
| 5,644,351 | A * | 7/1997 | Matsumoto et al. | 347/194 |
| 5,796,420 | A | 8/1998 | Kaerts et al. | |
| 5,808,653 | A * | 9/1998 | Matsumoto et al. | 347/194 |
| 6,747,682 | B2 * | 6/2004 | Kidoura et al. | 347/189 |
| 2004/0196353 | A1 * | 10/2004 | Hosokawa et al. | 347/191 |
| 2006/0132583 | A1 * | 6/2006 | Rich | 347/191 |

FOREIGN PATENT DOCUMENTS

EP 0 671 276 A1 3/1994

OTHER PUBLICATIONS

European Search Report for EP 04101372 (Aug. 20, 2004).

* cited by examiner

*Primary Examiner*—K. Feggins
(74) *Attorney, Agent, or Firm*—Leydig, Voit & Mayer, Ltd.

(57) ABSTRACT

Method of generating a sharpened image in a thermal printer having an internal thermal model module that converts input values into power values for each element of a thermal head and for each printing cycle. Input values to be fed into the internal thermal model are obtained by mathematically simulating the behavior of the printer.

7 Claims, 4 Drawing Sheets

THERMAL PRINTING METHOD

This application claims the benefit of U.S. Provisional Application No. 60/567,877 filed May 4, 2004, which is incorporated by reference. In addition, this application claims the benefit of European Application No. 04101372.3 filed Apr. 2, 2004, which is also incorporated by reference.

FIELD OF THE INVENTION

The present invention relates to a thermal printing method, in particular to a method of generating a sharpened image by means of a thermal printer.

BACKGROUND OF THE INVENTION

In a thermal printer with a thermal head having a plurality of heating elements and a transport mechanism that causes a relative movement of a thermally sensitive material with respect to the thermal head, the printing process is typically divided into print cycles whereby in each print cycle the heating elements receive different amounts of energy appropriate to cause the wanted densities on the part of the media that is in contact with the thermal head during that cycle.

The thermally sensitive material maybe composed of a donor sheet and an acceptor sheet as in the diffusion transfer process or maybe film or sheet of paper that is thermally sensitive by itself.

The present invention relates in particular to a printing method to be used in a thermal printer intended for applications that require high image quality such as printers for medical diagnosis.

In such a printer, images are supplied by a host computer, hereafter called "host-images" that have digital values directly or indirectly corresponding to the wanted density of a certain area on the printed media. This area is called a "host-pixel" further on. In case of a colour printer, each value corresponds directly or indirectly to the density of one specific colorant of the colour image. For each "host-pixel" and for each colour printed, one value is required.

The host-image is typically organised in rows and columns, whereby in one specific case each column corresponds to one heating element of the head and each row corresponds to one print cycle of the printing process. In all other cases, the source image has to be transformed into a new image with a different number of values so that each value corresponds to a heater element in a specific print cycle. This transformation is well known as "interpolation".

If the resulting pixels of the printer-image are not directly corresponding to the densities wanted on the media, there is usually a translation mechanism that translates the "user" meaning of the values into a value that corresponds to the wanted density effect on the media (see FIG. 1).

Because the media can only be influenced by temperature of the heating elements, the density values must be translated into a temperature value for the heating elements. This is done using the sensitometry information of the media. This sensitometry information is obtained usually during a media calibration before using such a printer. Most printers have automatic means to perform a media calibration when entering new media into the printer.

At this point, the image is available as "wanted temperature" for each heating element during each heating cycle.

The only driving parameter the printer has available is the power it injects into each heating element during each heating cycle.

The amount of power that a printer needs to reach the wanted temperature for a certain density is highly dependent on different temperatures in the system. Therefore, in state of the art printers each printing cycle a line of the wanted temperature image is fed into a 'thermal model' along with measured temperatures and a state variable to calculate a line of power values which then are used to drive the heating elements. The State variable is a set of values that assist the thermal model to compensate for the temperature rise in the thermal head and the lateral heat distribution (see FIG. 2). An example of such a thermal model can be found in European patent application 671 276.

This thermal model has to run real-time and should therefore not be complicated, especially if it runs on a computer that has several other tasks to perform.

Without this thermal model, thermal printers would render very poor image quality and be unstable in density reproduction. Using a thermal model, state of the art printers are capable of producing images that are acceptable for medical application.

Most state of the art printers have an additional correction of the power-values to correct for the different behaviour of the individual heating elements (FIG. 3). This additional correction prevents uneveness along the thermal head due to variation in element properties such as resistance values of the heating resistors.

Although the quality of thermal printers is accepted, images of wet laser printers compared to state of the art thermal printers are still easier to read.

The cause of this effect is explained by means of an experiment illustrated in FIG. 4.

Suppose a density profile corresponding with a step function is printed, both on a state of the art thermal printer and on a laser printer and then the printed result is measured using a scanning micro densito meter.

In FIG. 4 curve A represents the wanted density for a transition from low to high density in transport direction, curve B is the density curve obtained by means of a typical wet laser printer, curve C is the resulting density curve of a typical state of the art thermal printer. Curve C is the result of the printer behaviour combined with the sensitometric transformation characteristic of the recording material.

Curve B of the laser printer has a typical shape due to the Gaussian beam distribution of the laser spot used to write the image. Already at a distance equal to a few times the spotsize of the laser from the edge, the density profile has reached its final value.

Curve C pertaining to the thermal printer clearly shows that at the first 2 mm after increasing the wanted density, the thermal model is not capable to predict the needed amount of power correctly.

FIG. 5 pertains to the direction parallel with the thermal head. Curve A represents the wanted density for a transition from low to high density in a direction parallel with the thermal head. Curve B is the resulting density curve of a typical wet laser printer. It is basically the same as the laser curve in the transport direction. Curve C is the resulting density curve of a typical state of the art thermal printer.

Curve C pertaining to the thermal printer clearly shows that in the first 1 mm distance from the edge of the low to high density transition, the thermal model is not capable to predict the needed amount of power correctly.

From these measurements can be concluded that some sharpness is lost due to the fact that the dynamics of heat storage in the head and the lateral heat spread along the head are not accurately modelled in the thermal model.

A way of solving this problem could be to simulate the heat distribution in the head using a Finite Element Model that is capable of predicting the temperatures in the neighbourhood of the heating elements very accurately and therefore also enables a computer system to calculate the required power to heat the elements to a desired value to any degree of accuracy.

Although a FEM model is capable of performing the task, a very expensive computer would be needed to run it at sufficient speed to serve as part of the thermal model in the printer.

SUMMARY OF THE INVENTION

The above-described objects are solved by a method as set out in claim 1 and dependent claims.

Further details will become apparent from the detailed description given below.

DETAILED DESCRIPTION OF THE INVENTION

Figure 1:
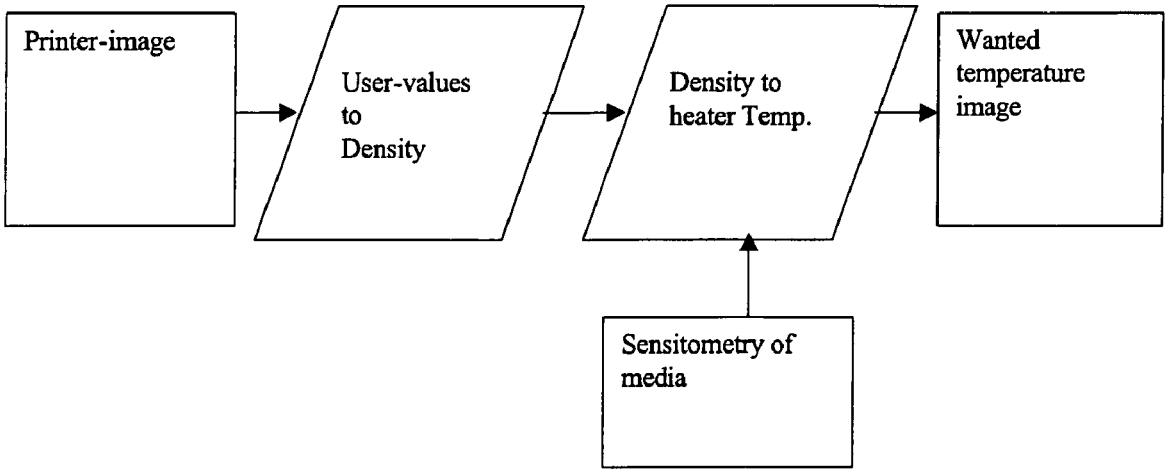
FIG. 1 illustrates the conversion of a 'printer image' into a 'wanted temperature image'.
Figure 2:
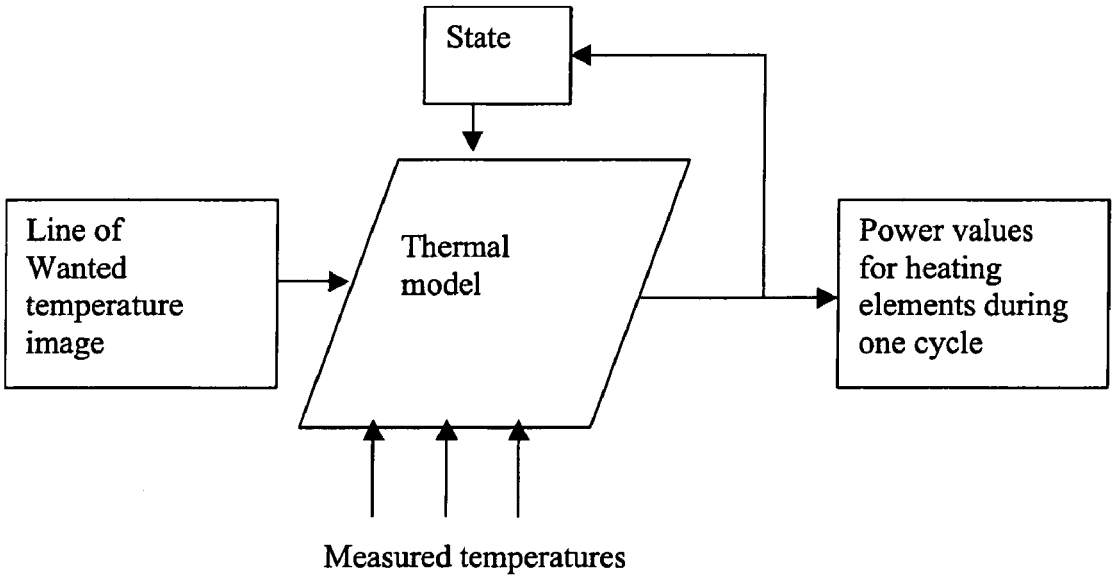
FIG. 2 illustrates the concept of 'thermal model'.
Figure 3:
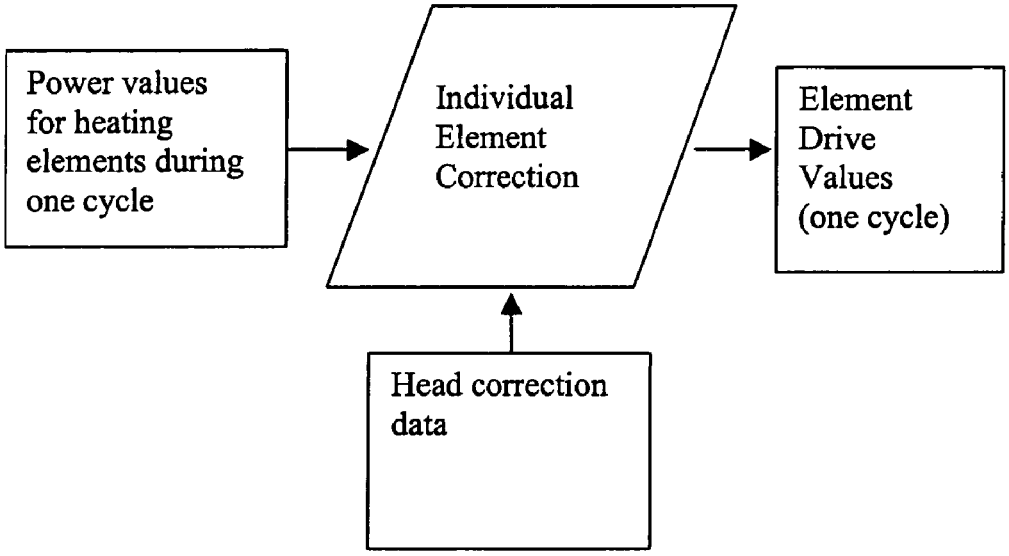
FIG. 3 illustrates the correction of power values for different behaviour of individual heating elements.
Figure 4:
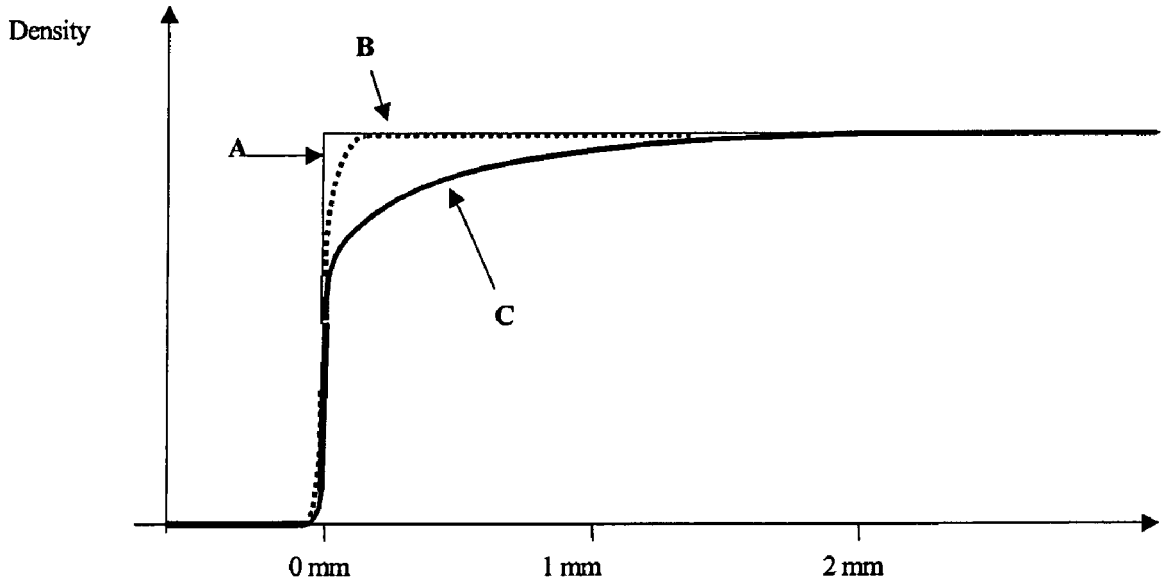
FIG. 4 is the result obtained by applying a profile which is a low to high transition in transport direction of the recording material.
Figure 5:
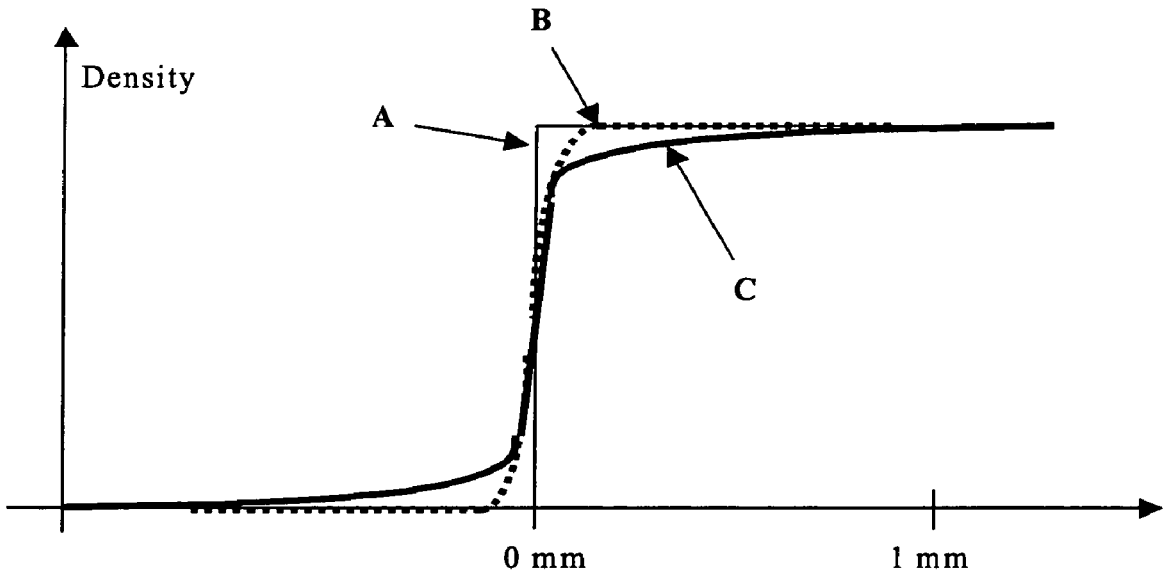
FIG. 5 is the result obtained by printing a transition which is a low to high transition in the direction of the thermal head.

According to this invention a module is developed which can be placed between the "wanted temperature image" and the "thermal model" of the state of the art printer as shown in FIG. 2 and that improves the sharpness of the images without requiring expensive hardware upgrades of the printer.

This module is further on referred to as TML (Temperature Modification Layer).

The "wanted temperature image" can be written as a matrix of digital values Mtw whereby each row Ktw of the matrix represents the "wanted temperature" values for a given print cycle and the columns Ttw of the matrix represent the "wanted temperature" values for a given heating element of the head for all print cycles of the image to be printed.

A print cycle is a period of time corresponding to an area on the recording medium during which wanted densities along the print head have a certain value.

First Embodiment

In one embodiment of the invention a function F(Ktw,b,c, . . . ) is defined that accepts a number of fixed parameters b,c . . . and an array of values Ktw, representing the wanted temperatures for one cycle of the printing process.

The function F(Ktw,b,c, . . . ) returns a vector Ft of the same size as Ktw.

The function F can be any function but is preferably a simple one.

Parameter 'b' controls the dynamic behaviour of the function and parameter 'c' controls the output amplitude of the function.

Also additional parameters further controlling the function behaviour may be available.

An example of such a function is a function that creates a new vector out of Ktw whereby each element of the new vector is the sum of b elements of Ktw, multiplied by c/b. (See formula 1) The first and last b/2 elements of Ft are calculated with an adapted formula, whereby the missing elements of Ktw are substituted by zero's:

$$Ft_i = \frac{c}{b} \cdot \sum_{j=i-\frac{b}{2}}^{i+\frac{b}{2}} Ktw_j \qquad \text{(formula 1)}$$

When more than b subsequent elements of Ktw have an identical value V, the corresponding elements of Ft will have value 'c.V', after a transition region of 'b' elements wide.

Many other simple functions can be defined that evolve to a stable value 'c.V' and have a parameter 'b' that controls the number of elements to do so.

We define also a 'matching function' :

$$Fm()=a.Ktw+F(Ktw,b,c, \ldots), \text{ whereby } a=1-c.$$

This 'matching function' has the important property that it does not alter the steady state values of Ktw and that it has a shape which to a certain extent simulates the behaviour of the printer when applying a vector Ktw during a printcycle.

In a next step of the procedure the parameters b,c, . . . of function F() are set so that Fm() combined with the sensitometry of the recording material optimally simulates the (thermal) behaviour of the printer.

The following procedure can be used to set these parameters. However, alternative methods are possible such as using the TML step defined below with different parameter settings and visually selecting the optimal result.

First a test pattern is printed for each print cycle using a vector KTW_test (which represents a test pattern), for example an image corresponding with a step function (a step-wise transition from a low value to a high value) evolving in the direction of the thermal head is printed using the printer with TML switched off. The step function must be such that both low value and high value produce a measurable density on the media.

The printed film-sheet is accurately measured, and a step function response measured in densities is obtained.

This step function response in densities is transformed into values proportional to wanted heating element temperatures using sensitometry information of the recording material that is used. The vector of these values is indicated with symbol Ktm.

Using Ktw_test we calculate Ktp using the matching function:

$$Ktp=a.\ Ktw_\text{test}+F(Ktw_\text{test},b,c, \ldots)$$

We now run an optimising process whereby the parameters of b,c, . . . for F() are modified to obtain a best match between Ktp and Ktm. Such an optimising process is available in MathCad working sheets or the like (MathCad is a trademark of Mathsoft Engineering & Education Inc.).

Occasionally parameter 'a' can likewise be determined during this optimising process.

After setting the parameters, the matching function is a prediction of the printer's behaviour.

Next, according to TML the rows Ktw of the matrix Mtw are changed using formula 2:

$$Ktwc=1/aopt*(Ktw-F(Ktw,bopt,copt,\ldots)) \quad \text{(formula 2)}$$

For large area with the same value for each element $Ktw_i$ of Ktw, we already discussed that $Ft_i=c.Ktw_i$.

In these regions of the vector Ktw, $Ktwc_i=Ktw_i$ since a=1−c.

This means that formula (2) does not change overall densities and that the module can be inserted without changing the density stability of the system. Furthermore, because the behaviour of the changing function is matched to the measured behaviour of the printer, the changed temperature vector Ktwc will result in a more accurately printed density pattern and therefore a sharper image.

The result of the above described TML process is input of the thermal model of the printer and adapted driving power values for each of the elements of thermal head are generated.

Second Embodiment

In another embodiment of the invention a function F(Ttw, b,c, . . . ) is defined that accepts a number of fixed parameters b,c . . . and a vector of values Ttw, representing the wanted temperatures for a given heating element for all printing cycles of the printing process.

The function F() returns a vector Ft of the same size as Ttw. It can be any function but preferably a simple one. Parameter 'b' controls the dynamic behaviour of the function and parameter 'c' controls the output amplitude of the function. Also additional parameters further controlling the function behaviour may be available.

An example of such a function creates a new vector out of Ttw whereby each element of the new vector is the sum of b elements of Ttw, multiplied by c/b.

(see formula 3).

The first b elements of Ft are calculated with an adapted formula, whereby the missing elements of Ttw are substituted by zero's:

$$Ft_i = \frac{c}{b} \cdot \sum_{j=i-b}^{i-1} Ttw_j \quad \text{formula 3}$$

When more than b subsequent elements of Ttw have an identical value V, the corresponding elements of Ft will have value 'c.V', after a transition region of 'b' elements wide.

Many other simple functions can be defined that evolve to a stable value 'c.V' and have a parameter 'b' that controls the number of elements to do so.

We define also a 'matching function' Fm()=a.Ttw+F(Ttw, b,c, . . . ), whereby a=1−c.

The next steps are similar to the embodiment that provided a improved temperature in head direction.

Third Embodiment

In yet another embodiment of the invention a function F(Mtw,b,c,d, . . . ) is defined which accepts a number of fixed parameters b,c,d . . . and a matrix of values Mtw, representing the wanted temperatures for all heating elements and all printing cycles of the printing process and that generates a new matrix Ft as output.

In this embodiment the function F() influences both details along the head direction as details along the transport direction whereby the behaviour in head direction is mainly determined by a subset of parameters of the parameters b,c,d . . . . and the behaviour in transport direction is mainly determined by (another) subset of parameters of b,c,d . . .

The function F() can be any function but again preferably a very simple one.

An example of such a two dimensional function is a function which renders the sum of b.d elements of the matrix Mtw. (See formula 4). In the border-regions the missing elements of Mtw are substituted by zero's.

$$Ft_{i,j} = \frac{c}{b \cdot d} \cdot \sum_{k=i-b}^{k-1} \sum_{l=j-\frac{d}{2}}^{j+\frac{d}{2}} Mtw_{k,l} \quad \text{formula 4}$$

When a rectangular area of substantially more than b.d elements of Mtw have an identical value V, the corresponding elements of Ft will have value 'c.V', after a transition region of 'b' elements in transport direction and 'd' elements in head direction.

Many other simple functions can be defined that evolve to a stable value 'c.V' and have parameters 'b' and 'd' that control the number of elements to do so.

We define also a 'matching function' Fm()=a*Mtw+F(b, c,d . . . ,Mtw), whereby a=1−c.

The next steps are similar to the embodiments that provided a correction in head and transport direction separately.

More particularly, first the parameters of the function F() are determined, e.g. by performing the following steps.

A image corresponding with a test pattern such as a step-wise evolving pattern is printed. Generated densities are measured and a reference matrix Mtm is determined of values proportional to wanted heating temperatures using the sensitometry of the printing material.

Next, the same test pattern values are applied to said matching function resulting in a matrix Mtp.

Then an optimizing process is run to obtain an optimal match between Mtp and Mtm thereby modifying the parameters b, c, d, . . . . The parameters of the function F() are set to the values bopt, copt, dopt, . . . obtained at the end of the optimizing process.

Finally, the following values are applied as input values to the internal thermal model module of the printer: Mtwc=1/aopt(Mtw−F(Mtw, bopt,copt, dopt, . . . ).

Fourth Embodiment

In another embodiment of the invention, the function F() has an internal state St.

St can be a single value, an array of values, a two-dimensional matrix of values or any combination thereof.

In this embodiment, the state of the function St is initialised before calculation. After start of the calculation, the state St of the function enables the function to calculate the values Mtwc of a printing cycle based on the state St and the row of Mtw corresponding to a current printing cycle and the parameters b,c,d, . . .

An example such a function using a state variable is given below. Formula 4 is implemented in this example as a function using a state.

The state St of this function consists of a vector S and a matrix B and a pointer p.

Vector S has as many elements as Mtw has columns.

Matrix B has as many columns as Mtw and has b rows.

At each point in time, the values in S can be written as:

$$S_j = \sum_{j=0}^{b-1} B_{i,j}$$

Initially, all elements of S and B and pointer p are set to zero.

Now, the function of formula 4 for row i is calculated as follows (assume all rows <i have been calculated before)

Formula 4

$$Ft_{i,j} = \frac{c}{b \cdot d} \cdot \sum_{k=j-\frac{d}{2}}^{j+\frac{d}{2}} S_k$$

$$S_j = S_j - B_{p,j} + Mtw_{i,j}$$

$$B_{p,j} = Mtw_{i,j}$$

$$\text{If } p = b - 1 \text{ then } p = 0 \text{ else } p = p + 1$$

One can easily see that for row i=0, the procedure is correct.

For each following line, the array of sums is updated by subtracting the element that falls outside the range over which the sum has to be taken and this element is replaced by the proper element of Mtw, both in the buffer B and in the sum S. Therefor, the meaning of S is guaranteed at all times and the formula is correct for all values of i.

The same function is obtained, but 'b' additions are replaced by a subtraction, an addition and two memory operations per heating element. The setting of the pointer has to be done only once per line.

With large 'b' this 'state' approach will enable substantially faster calculation.

Generally, in the 'state' approach the function F() used both as part of the matching function Fm() and in the TML step consists of a function Fk(Ktw,St,b,c,d, . . . ) and a function Fs(Ktw,St,b,c,d, . . . ).

For the TML step the calculation follows the pattern below:

St=state of the calculation, initialized at start of printing.

Fk()=function that calculates a row of Ft from a row of Mtw and St and parameters Fs()=function that calculates the new state from a row of Mtw and St and parameters For each print cycle i we take a row of Mtw that is processed using Fk en Fs. First the changed temperatures for this row are calculated, then the state St is updated:

formulae 5

$$Ktw_j = Mtw_{i,j}$$

$$Ktwc = \frac{1}{a}(Ktw - Fk(Ktw, St, b, c, d, \ldots))$$

$$St = Fs(Ktw, St, b, c, d, \ldots)$$

$$Mtwc_{i,j} = Ktwc_j.$$

Fifth Embodiment

In yet another embodiment of the invention, the function Fs() uses the changed temperatures to calculate the state.

In this embodiment, the formulas relating to the TML step are the following:

formulae 6

$$Ktw_j = Mtw_{i,j}$$

$$Ktwc = \frac{1}{a}(Ktw - Fk(Ktw, St, b, c, d, \ldots))$$

$$St = Fs(Ktwc, St, b, c, d, \ldots)$$

$$Mtwc_{i,j} = Ktwc_j$$

Figure 6:
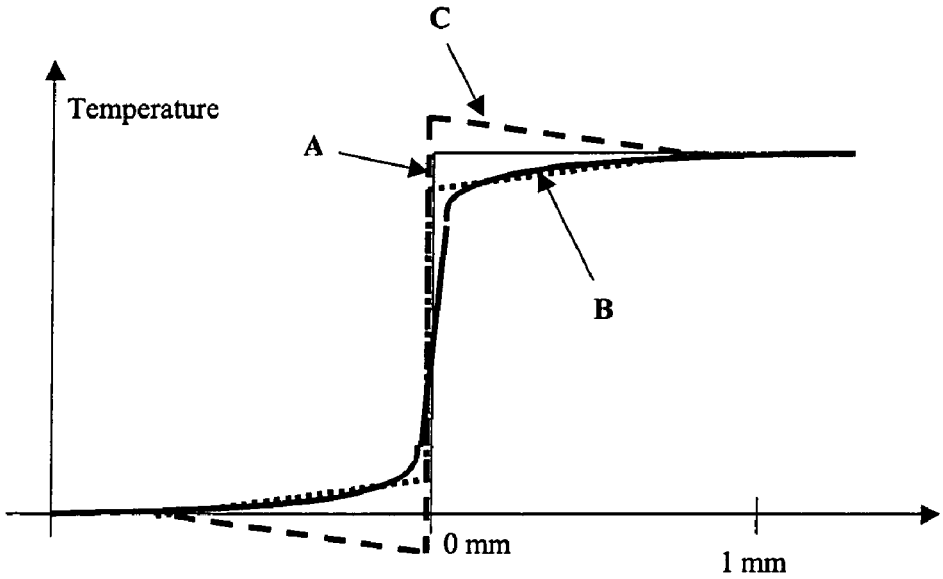
FIG. 6 illustrates one embodiment of this invention.

In FIG. 6 the best prediction 'A' for the embodiment using formula 1 of the behaviour of the printer 'B' and the resulting corrected Mtwc line 'C' is also shown.

Although this very simple function and the method of calibrating it provide an improvement on printer drive values with respect to sharpness, one can see that it is generally impossible for a simple function F() to model the behaviour correctly both close to the edge and at larger distances from the edge.

Sixth Embodiment

In another embodiment of the present invention, a set of identical functions F() of any of the types discussed in previous sections, with or without a state variable, is defined, whereby all functions accept the same set of parameters a,b,c,d, . . . but with different values for these parameters and each function also accepts Mtw or a row of Mtw in case the state approach is used.

Each function generates new matrices F1,F2,F3, whereby, if Mtw has a stable value V, the function values of F1,F2,F3 are c1.V,c2.V,c3.V respectively.

A matching function is now defined so that a=1−(c1+c2+c3+ . . . ) and $$Mtp = a.Mtw + F1(Mtw,b1,c1, \ldots) + F2(Mtw,b2,c2, \ldots) + F3(Mtw,b3,c3, \ldots) + \ldots$$

In order to set the parameters a,b1,c1, . . . etc, a measurement can be done on a known input pattern Mtw resulting in a density pattern which can be measured. Measured values can be converted to an equivalent temperature pattern Mtm.

Then a curve fitting process can be executed to fit Mtp to Mtm and thereby defining an optimal set of parameters.

After setting the parameters, the functions F1(),F2(), F3() . . . are used in the TML step as follows:

$$Mtwc = 1/a.(Mtw - F1(Mtw,b1,c1, \ldots) - F2(Mtw,b2,c2, \ldots) - F3(Mtw,b3,c3, \ldots) - \ldots)$$

The functions F1(),F2(),F3() . . . can be of any of the forms discussed in the embodiments above.

Figure 7:
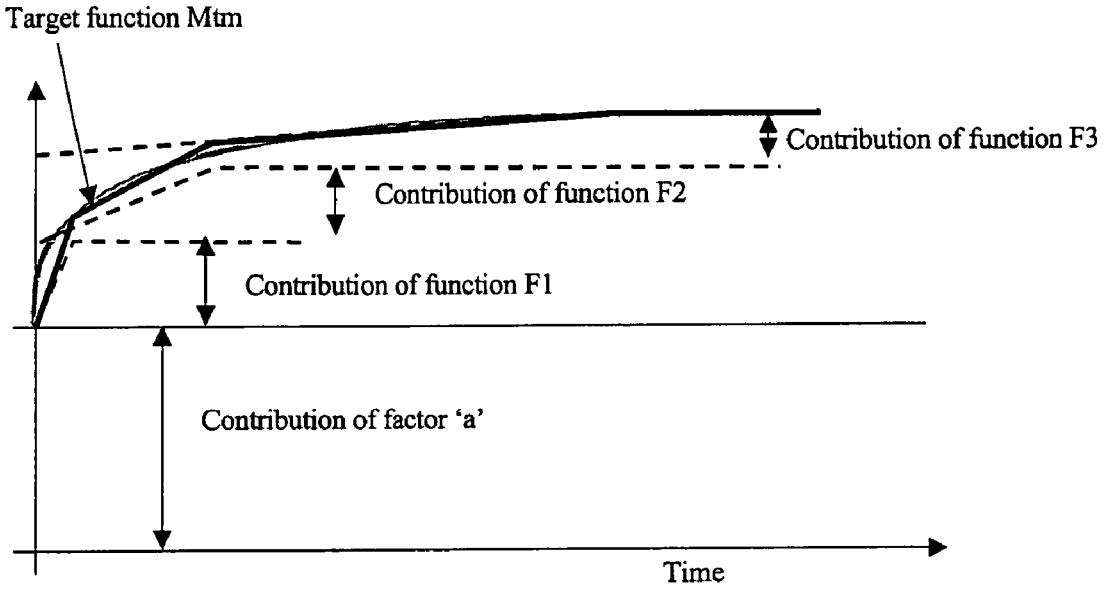
FIG. 7 illustrates an embodiment of this invention in which more than one function is used.

By using more than one function it is possible to model the printer's behaviour much more accurately as can be seen in FIG. 7.

Because the functions are identical they can be evaluated simultaneously by a vector processor available in modern CPU's such as ALTIVEC (ALTIVEC is a trade name of Motorola). Processing speed can be enhanced by keeping the functions F very simple and accuracy can be enhanced by including as much components as needed.

The invention claimed is:

1. Method of generating a sharpened image on a printing material in a thermal printer which comprises an internal thermal model module that converts input values into power values for each element of a thermal head and for each printing cycle, comprising the steps of:

defining a function F(Mtw, b, c, d . . . ) wherein Mtw is a matrix of wanted temperature values for each of the heating elements of a thermal head and for all printing cycles, wherein at least a subset of parameters b, c, d . . . influences the behaviour of the function along the direction of said thermal head and a subset of said parameters b, c, d influences the behaviour of the function in a direction in which said printing material is transported past said thermal head, defining a matching function Fm=aMtw+F(Mtw, b, c, d, . . . ) with a=1−c;

determining optimal values aopt, bopt, copt, dopt, . . . for said parameters a, b, c, d, . . . so that Fm(aopt, bopt, copt, dopt . . . ) simulates the behaviour of said printer applying values Mtwc to said internal thermal model, said values Mtwc being equal to 1/aopt*(Mtw-F(Mtw, bopt, copt, dopt, . . . )).

2. A method according to claim 1 wherein optimal values aopt, bopt, copt, dopt for said parameters a, b, c, d are determined by applying a test pattern to said thermal model module to generate a density pattern, measuring densities of said generated density pattern, calculating a reference matrix Mtm of values proportional to wanted heating element temperatures using the sensitometry of said printing material, calculating a matrix Mtp by applying said test pattern to said matching function, running an optimizing process to obtain optimal match between Mtp and Mtm thereby modifying said parameters a, b, c, d, . . . to generate values aopt, bopt, copt, dopt, . . . and setting the parameters of said function F() equal to said values aopt, bopt, copt, dopt . . . .

3. A method according to claim 2 wherein said test pattern is a step wise pattern.

4. A method according to claim 1 wherein parameters 'a' equals '1−c' and c represents the steady state value of said function F.

5. A method according to claim 1 wherein Mtw is a one dimensional array comprising values Ktw representing wanted temperature values for an individual cycle of the process of printing said sharpened image.

6. A method according to claim 1 wherein Mtw is a one dimensional array comprising values Ttw representing wanted temperature values for an element of the print head of said thermal printer.

7. A method according to claim 1 wherein $$F = \sum_i G(b_i, c_i, d_i \ldots ).$$

* * * * *